US009622603B1

(12) United States Patent
Coats

(10) Patent No.: US 9,622,603 B1
(45) Date of Patent: Apr. 18, 2017

(54) SHEET SKIRT

(71) Applicant: Djuana Coats, Parkland, FL (US)

(72) Inventor: Djuana Coats, Parkland, FL (US)

( * ) Notice: Subject to any disclaimer, the term of this patent is extended or adjusted under 35 U.S.C. 154(b) by 0 days.

(21) Appl. No.: 14/264,052

(22) Filed: Apr. 28, 2014

(51) Int. Cl.
*A47G 9/02* (2006.01)
*A47G 9/04* (2006.01)

(52) U.S. Cl.
CPC ..... *A47G 9/0292* (2013.01); *A47G 9/0246* (2013.01)

(58) Field of Classification Search
CPC .. A47G 9/0292; A47G 9/0246; A47G 9/0238; A47G 9/0223; A47G 9/0207; A47G 9/02; A47C 31/105; A47C 31/10
USPC ..... 5/493, 482, 486, 496, 497, 498, 499
See application file for complete search history.

(56) References Cited

U.S. PATENT DOCUMENTS

| | | | | |
|---|---|---|---|---|
| 4,734,947 | A * | 4/1988 | Vitale | 5/493 |
| 5,285,542 | A | 2/1994 | West et al. | |
| 5,638,562 | A | 6/1997 | Masoncup | |
| 6,119,290 | A | 9/2000 | Masoncup | |
| 6,912,745 | B2 * | 7/2005 | Masoncup | 5/493 |
| 7,093,310 | B2 * | 8/2006 | Barros | 5/482 |
| 7,131,153 | B1 | 11/2006 | Charles et al. | |
| 2004/0163174 | A1 | 8/2004 | Treece | |
| 2004/0231053 | A1 * | 11/2004 | Masoncup | 5/493 |
| 2006/0143826 | A1 * | 7/2006 | Barros | 5/493 |

* cited by examiner

*Primary Examiner* — Robert G Santos
(74) *Attorney, Agent, or Firm* — Thien Tran, Esq.; Access Patent Group, LLC

(57) ABSTRACT

A sheet skirt for a bed having a mattress supported by a box spring comprising a fitted sheet adapted to fit on and around corners and edges of the mattress. A border is sewn to the fitted sheet. A bed skirt is sewn to the border. The border can be tucked in between the mattress and the box spring allowing the bed skirt to hang down about the box spring at a desired length to conceal the box spring.

7 Claims, 6 Drawing Sheets

SHEET SKIRT

BACKGROUND OF THE INVENTION

Field of the Invention

The present invention relates to bedding, and more particularly, a sheet skirt.

Many people prefer to include a bed skirt in with their bedding sets. However, it can be difficult for a user to put a bed skirt on the box spring because this involves lifting the mattress out of the way. This can be time consuming and cause unnecessary strain on the user. If an individual's bed has a footboard but they still want to use a bed skirt, they would usually have to go to the trouble of tucking the extra material somewhere, so that it is out of the way. An easier, more adaptable option is needed so that people can use a bed skirt, without all the hassle.

The sheet skirt allows users to eliminate the hassle of lifting up a mattress to add a bed skirt. This product makes it possible to add the decorative touch that bed skirts can bring to a room without having to lift a heavy, awkward mattresses. Users could simply place the sheet skirt on their mattress and tuck it in, so that the bed skirt hangs at a desired length. They could then enjoy the aesthetics of having a concealed box spring. The present invention can also be used on beds that have a footboard. Anyone with a decorative eye will enjoy the sheet skirt. By making the sheet skirt border adjustable allows for different size bed the benefit of use of the present invention.

Description of the Prior Art

Numerous innovations for bedclothes have been provided in the prior art that will be described. Even though these innovations may be suitable for the specific individual purposes to which they address, however, they differ from the present invention.

A FIRST EXAMPLE, U.S. Pat. No. 5,285,542, Issued on Feb. 15, 1994, to West et al. teaches a mattress pad or cover for a conventional inner-spring or foam type mattress. The mattress cover has a quilted cover portion and a downwardly depending peripheral skirt that wraps around the mattress to hold the cover portion in place. The skirt has elastic sewn around its lower peripheral edge to keep the skirt tucked under the mattress. The cover portion has a first thick layer of fiberfill and a second conterminous thin layer of fiberfill. A metalized film is needle-punched to the thin fiberfill layer and a fabric cover envelops a fiberfill and film layers.

A SECOND EXAMPLE, U.S. Pat. No. 5,638,562, Issued on Jun. 17, 1997, to Masoncup teaches a fitted bed sheet foundation and a dust ruffle for placement onto a mattress and around a box spring of a bed. The fitted bed sheet foundation comprises: a sheet of material, the sheet is sized to fit on and around corners and edges of a mattress, the sheet is of a sufficient size so that when it is laid over the mattress a lower edge of the sheet extends downwardly below and alongside the mattress with a lowermost edge area of the sheet positioned in confronting relation to a box spring, and a first fastener, the first fastener is secured at outer edges on the lowermost edge area of the sheet. The dust ruffle comprises: a sheet of dust ruffle material, the sheet of dust ruffle material is long enough to embrace sides of the box spring, a band of flat material, the band of flat material is attached along an upper edge of the dust ruffle material, and a second fastener, the second fastener is secured at inner edges along the upper edge of the band of flat material, the second fastener is spaced in such relation so that the second fastener located on the inner edge of the dust ruffle is securable to the first fastener located on the outer edge of the fitted bed sheet foundation and can then be tucked by a person's fingers a desired distance under the mattress in between the mattress and the box spring thereby providing a fitted bed sheet foundation and dust ruffle that is easy to install and remove on a mattress foundation.

A THIRD EXAMPLE, U.S. Pat. No. 6,119,290, Issued on Sep. 19, 2000, to Masoncup teaches a dust ruffle structure sized and shaped to be positioned on and around a lower supporting structure and underneath an upper mattress on a bed comprising: a sheet of dust ruffle material, the sheet of dust ruffle material being long enough to embrace sides of the bed, and a friction fastening structure. The friction fastening structure has a non-slip, friction surface, the friction fastening structure is secured along the length of the sheet of dust ruffle material at an upper edge thereof, whereby the upper edge of the sheet of dust ruffle material can then be tucked by a person's fingers a desired distance underneath the upper mattress in between the upper mattress and the lower supporting structure. The desired distance is sufficient to enable a weight of the upper mattress to compress against the friction fastening structure, wherein the combination of the weight of the upper mattress and a friction force of the friction fastening structure coact to keep the dust ruffle structure securely in between the upper mattress and the lower supporting structure and further provide a resistance from pulling the dust ruffle structure out of an adjusted position.

A FOURTH EXAMPLE, U.S. Patent Office Publication No. 2004/0163174, Published on Aug. 25, 2004, to Treece teaches a fitted mattress pad for covering the top and sides of a mattress, includes a first layer of material, a second layer of material and a layer of batting intermediate the first and second layers. The pad also comprises a skirt for covering the sides and ends of a mattress. One of the first and second layers is generally sized to a peripheral dimension to form the top platform of a mattress pad. The batting layer is generally sized to a peripheral dimension to form the top platform of a mattress pad. The skirt is an integral extension of one of the first or second layers of the mattress pad. The first layer, second layer and batting layer are joined together to form a unitary mattress pad.

A FIFTH EXAMPLE, U.S. Pat. No. 7,131,153, Issued on Nov. 7, 2006, to Charles teaches a bed skirt guard designed to fit between the mattress and box spring wherein the sides form a box around the top of the box springs. This prevents the bed skirt from getting caught and pulled under the mattress when changing the sheets on the bed or tucking in the covers. The bed skirt guard is comprised of a flexible plastic material that allows the sheets and or blankets to slide easily. Since the bed skirt guard hangs over the sides of the box springs it keeps the bed skirt in place.

A SIXTH EXAMPLE, U.S. Pat. No. 7,140,053, Issued on Nov. 28, 2006, to Mangano teaches a combination flat sheet, fitted sheet and bed skirt that includes a fitted sheet having a top and four sides, each side having a lower edge, the four lower edges being provided with an elastic band, the fitted sheet dimensioned to fit over a mattress supported by a box spring. The bed skirt is attached only to the left, right and foot peripheral edge of the top of the fitted sheet and extends downward in sufficient length to cover the left, right and foot sides of the fitted sheet and the left, right and foot sides of the box spring. The flat sheet is attached only to the foot edge of the top of the fitted sheet and is dimensioned such that its left, right and foot flaps extend downward in sufficient length approximately to or just beyond the box spring.

The length of the flat sheet in the head direction is of sufficient length such that the sheet can be folded over itself at the head of the bed.

It is apparent now that numerous innovations for bedclothes have been provided in the prior art that are adequate for various purposes. Furthermore, even though these innovations may be suitable for the specific individual purposes to which they address, accordingly, they would not be suitable for the purposes of the present invention as heretofore described.

SUMMARY OF THE INVENTION

AN OBJECT of the present invention is to provide a sheet skirt that avoids the disadvantages of the prior art.

ANOTHER OBJECT of the present invention is to provide a sheet skirt that is simple and inexpensive to manufacture.

STILL ANOTHER OBJECT of the present invention is to provide a sheet skirt that is simple to use.

BRIEFLY STATED, STILL YET ANOTHER OBJECT of the present invention is to provide a novel sheet skirt.

The novel features which are considered characteristic of the present invention are set forth in the appended claims. The invention itself, however, both as to its construction and its method of operation, together with additional objects and advantages thereof, will be best understood from the following description of the specific embodiments when read and understood in connection with the accompanying drawing.

BRIEF DESCRIPTION OF THE DRAWING

The figures of the drawings are briefly described as follows.

REFERENCE NUMERALS UTILIZED IN THE DRAWING

Figure 1:
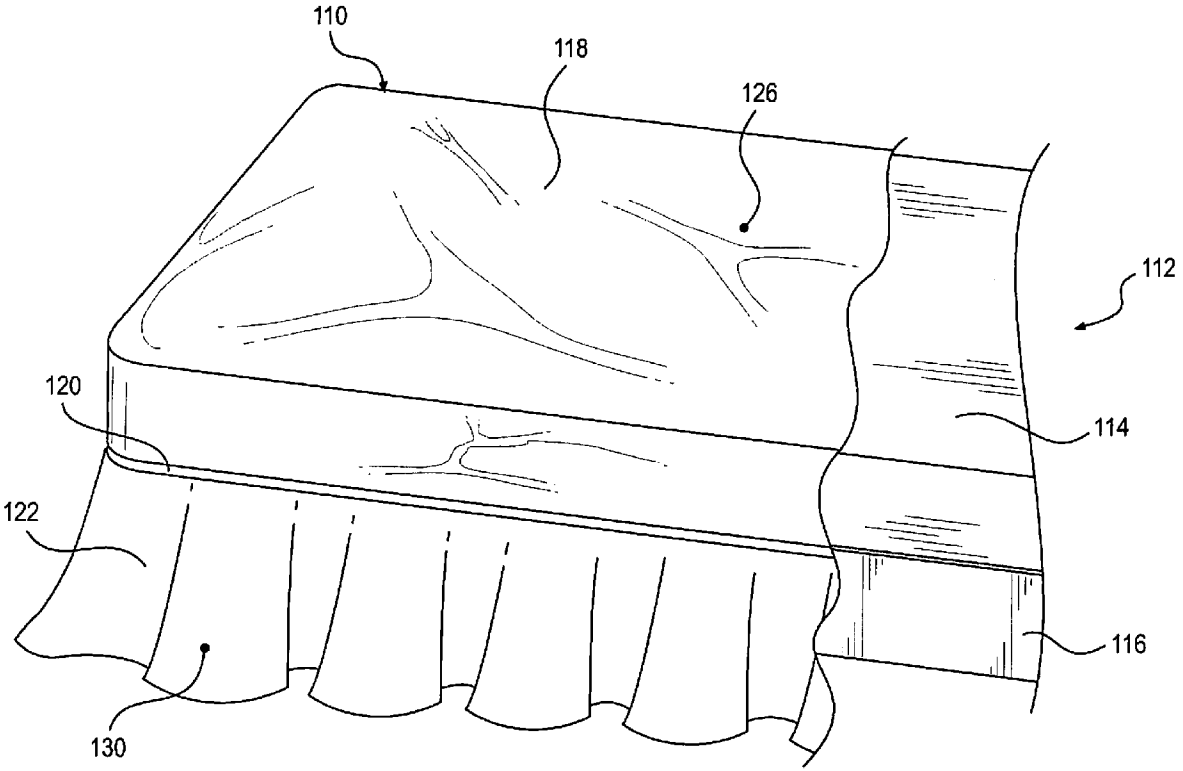
FIG. 1 is a perspective view of the present invention in use.

110 sheet skirt
112 bed
114 mattress of bed 112
116 box spring of bed 112
118 fitted sheet of skirt sheet 110
120 border of sheet skirt 110
122 bed skirt of sheet skirt 110
122A first side or left side of the bed skirt
122B second side or right side of the bed skirt
122C third side or front side of the bed skirt
124 adjustable material for border 120
126 one hundred percent cotton and cotton blends for fitted sheet 118
128 one hundred percent polyester for border 120
130 one hundred percent polyester for bed skirt 122
132 splits at borders

DETAILED DESCRIPTION OF THE PREFERRED EMBODIMENT

Figure 2:
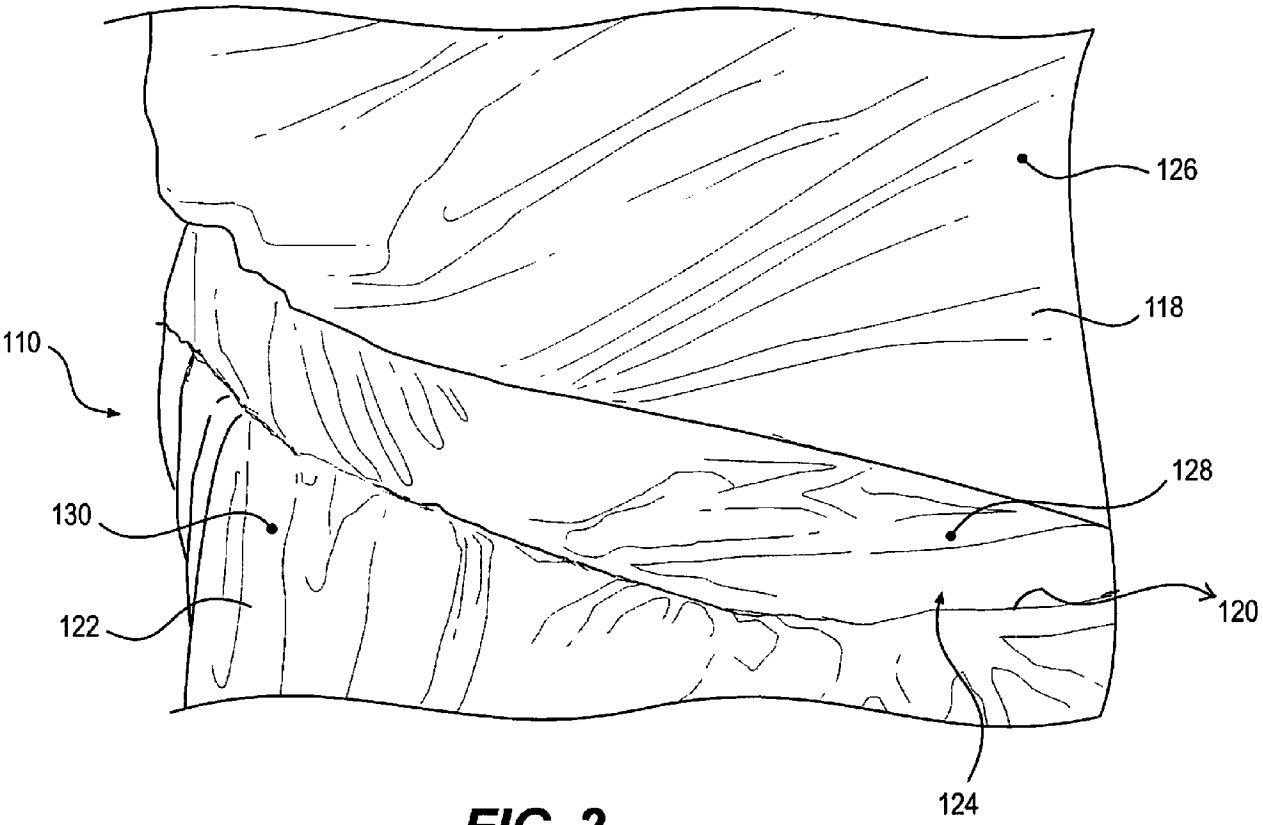
FIG. 2 is a perspective view showing the border that connects the fitted sheet to the bed skirt.
Figure 3:
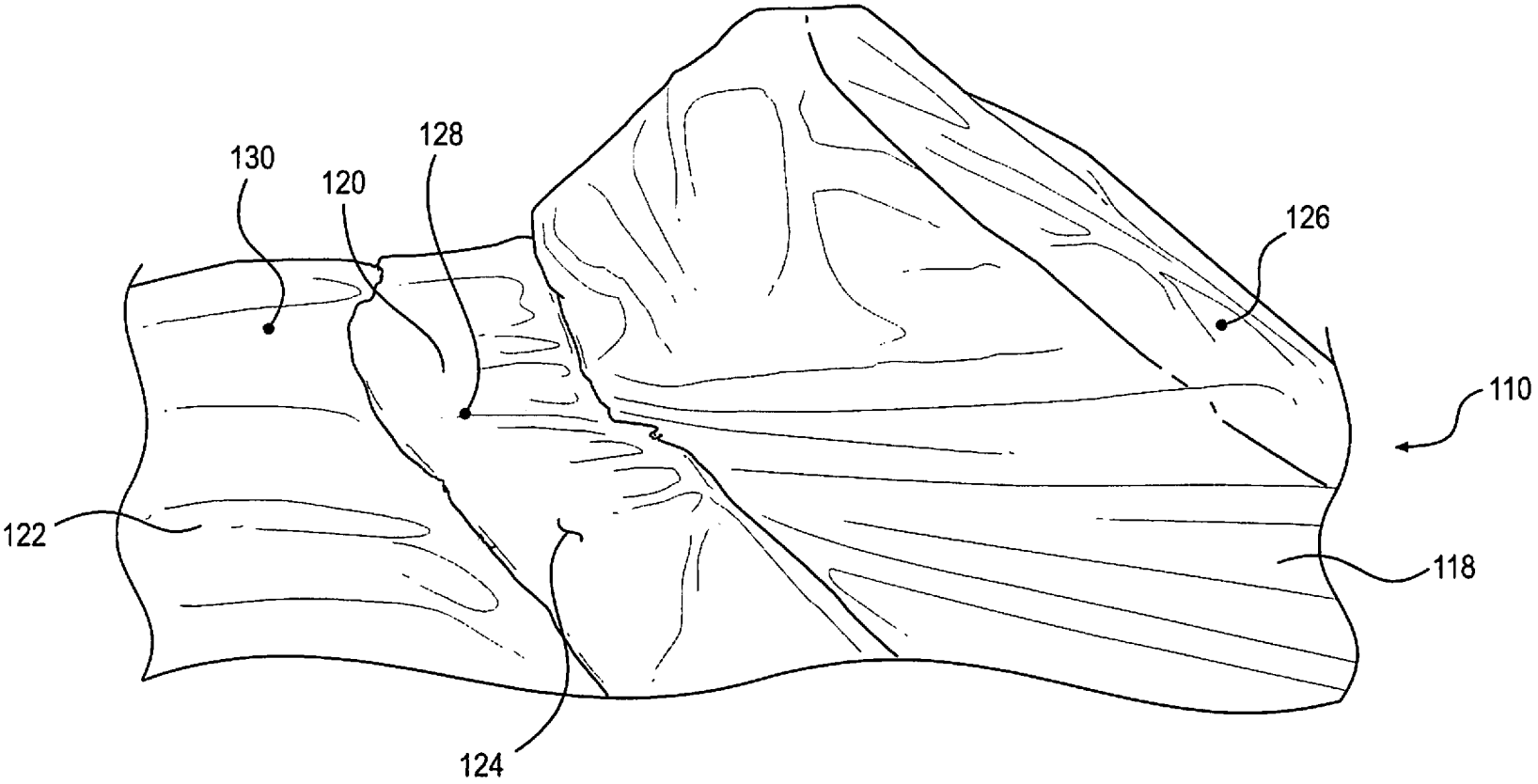
FIG. 3 is a perspective view showing another view of the present invention.

As shown in FIGS. 1 through 3, the present invention is sheet skirt 110 for a bed 112 having a mattress 114 supported by a box spring 116. The sheet skirt 110 comprises a fitted sheet 118 adapted to fit on and around corners and edges of the mattress 114. A border 120 is sewn to the fitted sheet 118. A bed skirt 122 is attached by sewing, zippers, Velcro, buttons or snaps to the border 120. The border 120 can be tucked in between the mattress 114 and the box spring 116 allowing the bed skirt 122 to hang down about the box spring 116 at a desired length to conceal the box spring 116.

The border 120 is comprised of an adjustable material 124 so as to extend from between three to seven inches in depth to fit on different sized mattress 114.

Figure 4A:
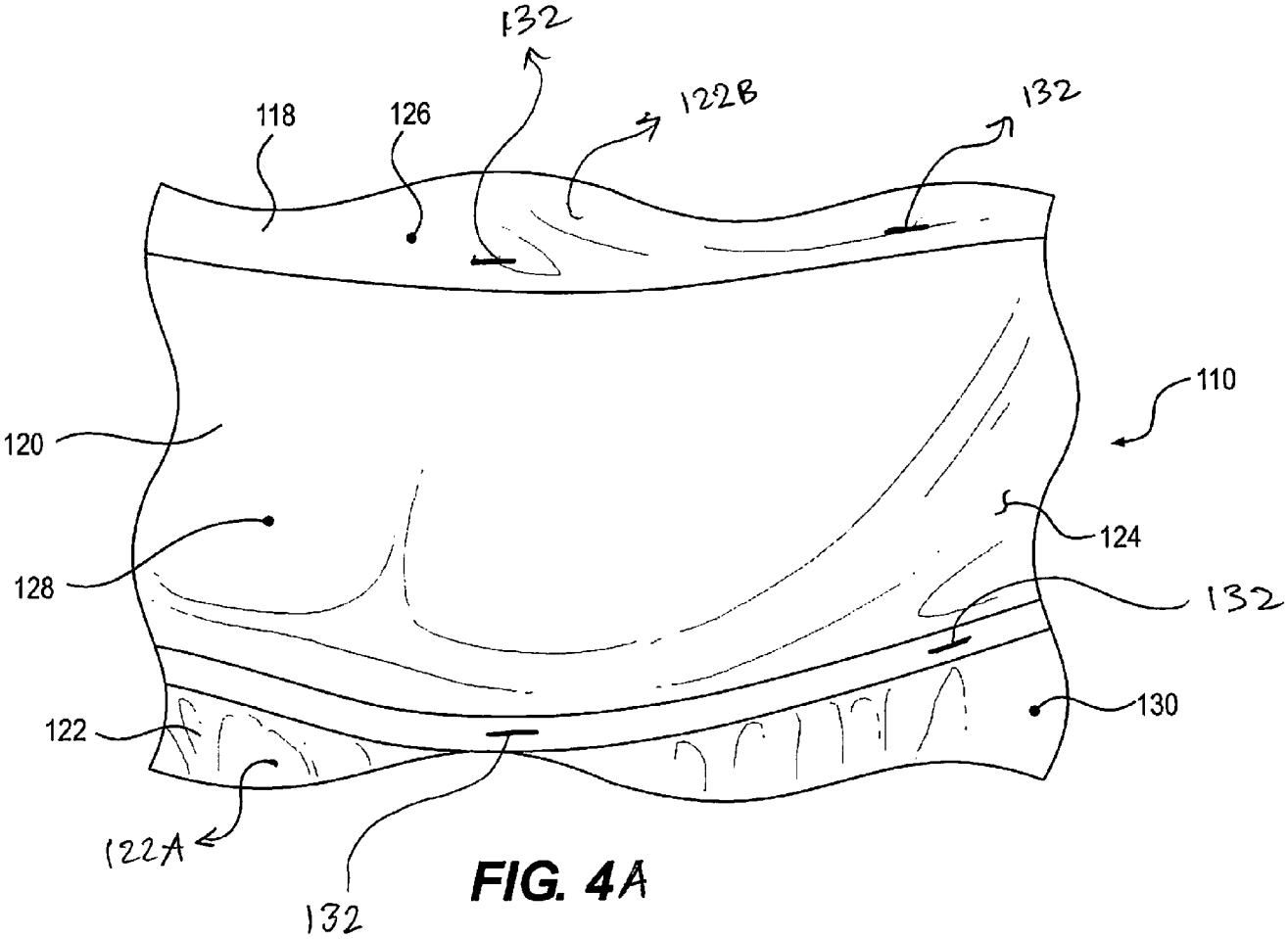
FIG. 4A is a perspective view showing a bed skirt can be comprised to hang only on two sides of the box spring, when the bed utilizes a framed footboard (not shown) and the border adjustable from three to seven inches to fit most mattresses.

In FIG. 4A: The bed skirt 122 can be comprised to hang only on two sides 122A, 122B of the box spring 116, when the bed 112 utilizes a framed footboard (not shown). Both corners at foot of the sheet skirt 110 may or may not have slits 132 to accommodate beds with or without footboards. Three 4×2 inch seamed slits 132 on left and right sides of the bed skirt to accommodate mattresses that use slats such as Tempur-pedic Beds. Depending on the size of the bed will determine exact measurements of the slits.

Example: A king size bed measuring 80 inches long, the slits 132 would be placed 13 inches from both the head and foot of the bed sheet and then another slit at 27 inches. The slits 132 will be inside attached border approximately 1 inch from the hanging skirt.

Figure 4B:
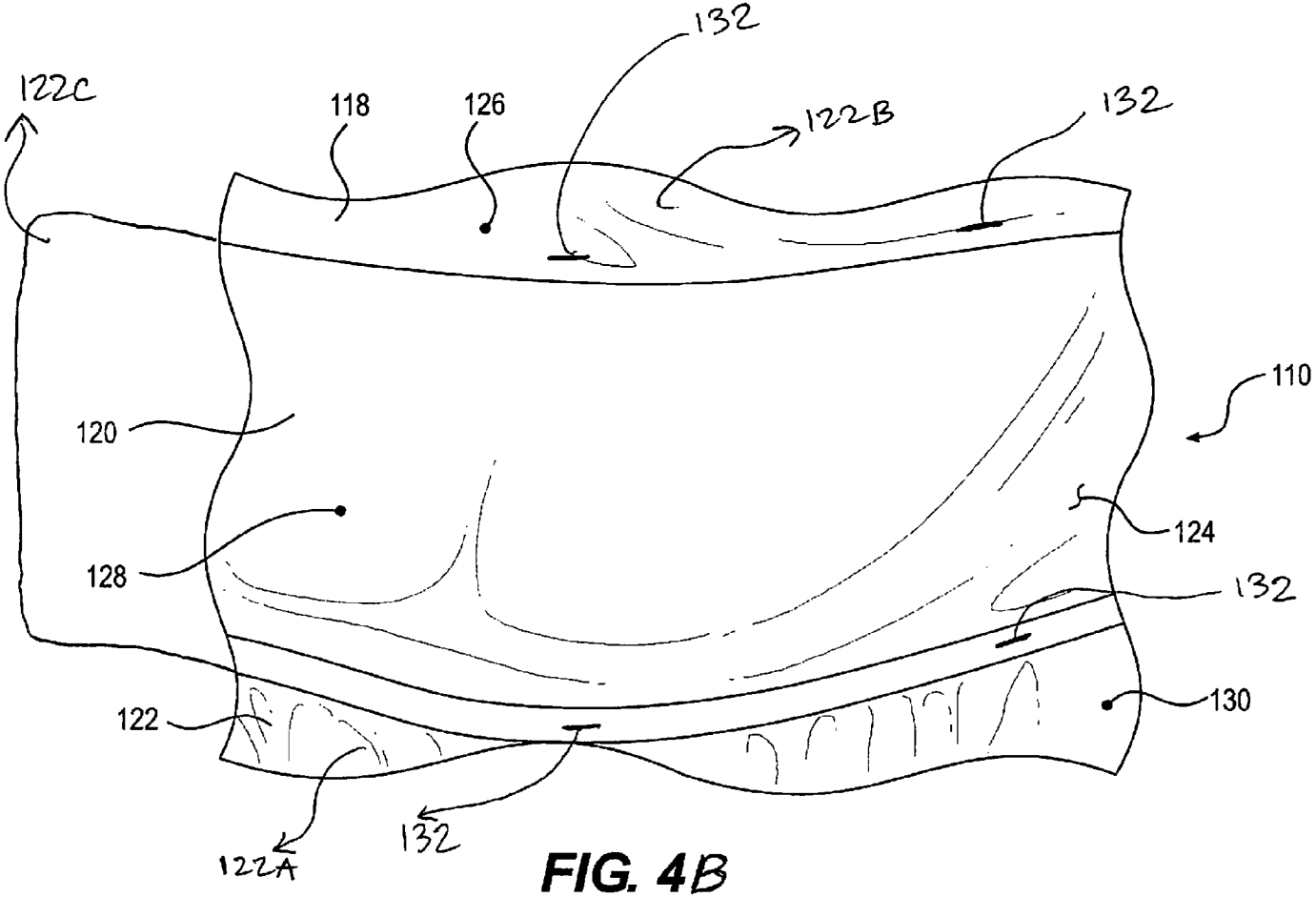
FIG. 4B is a perspective view showing a bed skirt can be comprised to hang three sides of the box spring, when the bed does not utilize a framed footboard (not shown) and the border adjustable from three to seven inches to fit most mattresses.

In FIG. 4B: Normally, the bed skirt 122 can be comprised to hang three sides 122A, 122B, 122C of the box spring 116, when the bed 112 does not utilize a framed footboard (not shown).

Figure 5:
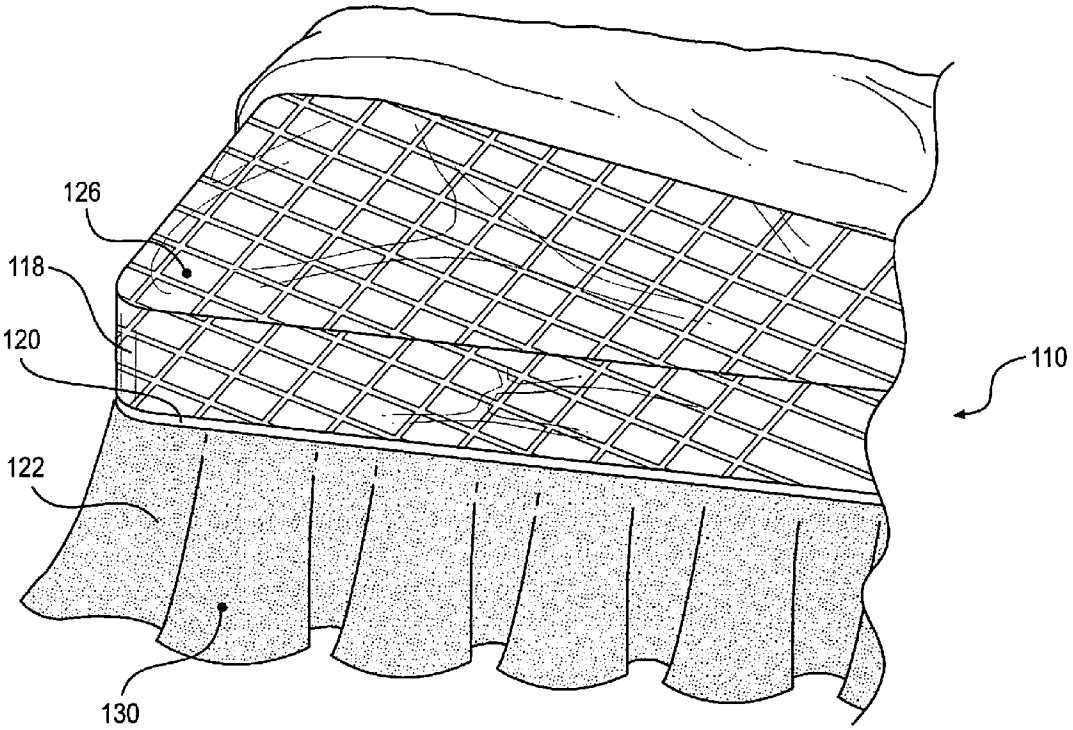
FIG. 5 is a perspective view showing the present invention in greater detail.

In FIG. 5: The fitted sheet 118 is comprised out of one hundred percent cotton and cotton blends 126. The border 120 is comprised out of one hundred percent polyester 128. The bed skirt 122 is comprised out of one hundred percent polyester 130 and is wrinkle free.

In review the sheet skirt 110 is a fitted sheet 118 with an attached bed skirt 122. The present invention is a fitted sheet 118 made for different size bed 112. The fitted sheet 118 is sewn to a border 120 that is also sewn to the bed skirt 122. The border 120 measures approximately three to seven inches allowing it be tucked in between a mattress 114 and a box spring 116. The border 120 is available in other sizes as long as the fitted sheet 118 and the bed skirt 122 are attached. The present invention may also be modified to have the hanging bed skirt 122 only on the two sides to accommodate various types of beds 112 with framed footboards and other specialty type mattresses 114.

A variety of colors, patterns, and materials are available to suit user preferences. Specifications may vary upon manufacturing.

It will be understood that each of the elements described above, or two or more together, may also find a useful application in other types of constructions differing from the types described above.

While the invention has been illustrated and described as embodiments of a sheet skirt, accordingly it is not limited to the details shown, since it will be understood that various omissions, modifications, substitutions and changes in the forms and details of the device illustrated and its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute characteristics of the generic or specific aspects of this invention.

The invention claimed is:

1. A sheet skirt for a bed having a mattress supported by a box spring comprising:

a) a fitted sheet adapted to fit on and around corners and edges of the mattress;

b) a border sewn to the fitted sheet;

c) a bed skirt attached by one of a attaching means consisting of: sewing, zippers, hook and loop fasteners, buttons or snaps to the border, whereby the border can be tucked in between the mattress and the box spring allowing the bed skirt to hang down about the box spring at a desired length to conceal the box spring; and wherein the border is comprised of an adjustable material so as to extend from between three to seven inches in depth to fit on different sized mattresses.

2. The sheet skirt as recited in claim 1, wherein the bed skirt is comprised to hang only on two sides of the box spring, when the bed utilizes a framed footboard.

3. The sheet skirt as recited in claim 1, wherein the bed skirt is comprised to hang only on three sides of the box spring, when the bed does not utilize a framed footboard.

4. The sheet skirt as recited in claim 1, wherein the fitted sheet is comprised out of one hundred percent cotton and cotton blends.

5. The sheet skirt as recited in claim 1, wherein the border is comprised out of one hundred percent polyester.

6. The sheet skirt as recited in claim 1, wherein the bed skirt of comprised out of one hundred percent polyester and is wrinkle free.

7. The sheet skirt as recited in claim 1, wherein the bed skirt includes three 4×2 inch seamed slits on left and right sides of the bed Sheet to accommodate mattresses that use bed slats.

* * * * *